US005578899A

United States Patent [19]

Haven et al.

[11] Patent Number: 5,578,899

[45] Date of Patent: Nov. 26, 1996

[54] FIELD EMISSION DEVICE WITH INTERNAL STRUCTURE FOR ALIGNING PHOSPHOR PIXELS WITH CORRESPONDING FIELD EMITTERS

[75] Inventors: Duane A. Haven; Chungdee Pong, both of Cupertino, Calif.

[73] Assignee: Silicon Video Corporation, Cupertino, Calif.

[21] Appl. No.: 343,075

[22] Filed: Nov. 21, 1994

[51] Int. Cl.[6] ..... H01J 29/18

[52] U.S. Cl. ..... 313/422; 313/495; 313/310; 313/292

[58] Field of Search ..... 313/422, 495, 313/309, 310, 336, 351, 292, 283, 288, 496, 461, 463, 466; 315/169.4; 345/75; 373/307, 238

[56] References Cited

U.S. PATENT DOCUMENTS

| | | | |
|---|---|---|---|
| 4,020,381 | 4/1977 | Oess et al. | 313/351 X |
| 4,163,949 | 8/1979 | Shelton | 313/309 X |
| 4,174,523 | 11/1979 | Marlowe et al. | 313/422 X |
| 4,577,133 | 3/1986 | Wilson | 313/422 X |
| 4,618,801 | 10/1986 | Kakino | 313/495 |
| 4,622,492 | 11/1986 | Barten | 313/422 |
| 4,857,799 | 8/1989 | Spindt et al. | 313/495 |
| 4,887,000 | 12/1989 | Yamazaki et al. | 313/422 |
| 4,900,981 | 2/1990 | Yamazaki et al. | 313/422 |
| 5,003,219 | 3/1991 | Muragishi et al. | 313/422 X |
| 5,063,327 | 11/1991 | Brodie et al. | 313/495 X |
| 5,160,871 | 11/1992 | Tomii et al. | 313/422 X |
| 5,170,100 | 12/1992 | Shichao et al. | 313/422 |
| 5,227,691 | 7/1993 | Murai et al. | 313/422 |
| 5,229,691 | 7/1993 | Shichao et al. | 313/422 X |
| 5,315,207 | 5/1994 | Hoeberechts et al. | 313/446 X |

FOREIGN PATENT DOCUMENTS

| | | |
|---|---|---|
| 0436997A1 | 7/1991 | European Pat. Off. . |
| 0464938A1 | 1/1992 | European Pat. Off. . |
| 0496450A1 | 7/1992 | European Pat. Off. . |
| 0580244A1 | 1/1994 | European Pat. Off. . |
| 93/18536 | 9/1993 | WIPO . |

*Primary Examiner*—Sandra L. O'Shea
*Assistant Examiner*—Ashok Patel
*Attorney, Agent, or Firm*—Wilson Sonsini Goodrich & Rosati

[57] ABSTRACT

A field emission display device has a faceplate and a backplate. The faceplate includes a faceplate interior side with an active region made of a plurality of phosphor pixel elements; and the backplate has a backplate interior side with a plurality of field emitters. Sidewalls are positioned between the faceplate and the backplate, to form an enclosed sealed envelope between the sidewalls, backplate interior side and the faceplate interior side. At least one spacer wall in the envelope supports the backplate and the faceplate against forces acting in a direction toward the envelope. At least one internal structure fixes and constrains the faceplate and the backplate, and aligns a plurality of phosphor pixels with corresponding field emitters. Additionally, the faceplate can include at least one faceplate fiducial, and the backplate include a corresponding backplate fiducial. The faceplate fiducial is optically aligned with the backplate fiducial. First, the spacer wall is positioned in the wall gripper. The faceplate and backplate fiducials are then optically aligned, and the spacer wall then introduced into the locator. Phosphor pixels are aligned with their corresponding field emitters. There is no need for external fixturing devices in the high temperature bonding and sealing processes of the display.

28 Claims, 12 Drawing Sheets

WALL LOCATION

FIELD EMISSION DEVICE WITH INTERNAL STRUCTURE FOR ALIGNING PHOSPHOR PIXELS WITH CORRESPONDING FIELD EMITTERS

CROSS-REFERENCE TO RELATED APPLICATIONS

This application is related to U.S. Pat. Nos. 5,477,105 and 5,424,605, and application Ser. Nos. 08/012,542, now allowed, all assigned to the same assignee.

BACKGROUND

1. Field of the Invention

This invention relates generally to field emission devices, and more particularly, to field emission devices with at least one internal structure that includes fiducials to optically align the faceplate and the backplate, and at least one internal structure that fixes and constrains the faceplate and backplate to align a plurality of phosphor pixels with corresponding field emitters.

2. Description of the Related Art

This application cross-references U.S. patent application Ser. Nos. 08/343,803, now allowed, and 08/343,074, now allowed, both assigned to the same assignee. Field emission devices include a faceplate, a backplate and connecting walls around the periphery of the faceplate and backplate, forming a sealed vacuum envelope. Generally in field emission devices, the envelope is held at vacuum pressure, which in the case of CRT displays is about $1\times10^{-7}$ torr or less. The interior surface of the faceplate is coated with light emissive elements, such as phosphor or phosphor patterns, which define an active region of the display. Cathodes, (field emitters) located adjacent to the backplate, are excited to release electrons which are accelerated toward the phosphor on the faceplate, striking the phosphor, and causing the phosphor to emit light seen by the viewer at the exterior of the faceplate. Emitted electrons for each of the sets of the cathodes are intended to strike only certain targeted phosphors. There is generally a one-to-one correspondence between each emitter and a phosphor.

Flat panel displays are used in applications where the form-factor of a flat display is required. These applications are typically where there are weight constraints and the space available for installation is limited, such as in aircraft or portable computers.

A certain level of color purity and contrast are needed in field emission devices. Contrast is the difference between dark and bright areas. The higher the contrast, the better. The parameters of resolution, color-purity and contrast in a flat cathodeluminescent display depend on the precise communication of a selected electron emitter with its corresponding phosphor pixels. Additionally, high picture brightness (lumens) requires either high power consumption or high phosphor efficiency (lumens/watt).

High power consumption in many applications is not desirable. Efficiency for many phosphors increases as the operating anode voltage increases; and the required operating brightness can be achieved with lower power consumption at high voltage, as illustrated in FIG. 1. In order to satisfactorily operate at high anode voltages, e.g., 4 kV or higher, the backplate containing the emitter array must be spatially separated from the faceplate, containing the phosphor pixels, by a distance sufficient to prevent unwanted electrical events between the two. This distance, depending on the quality of the vacuum and the topography of the substrates, is typically greater than about 2 mm.

With the constraints of faceplate and backplate glass area and thickness, the vacuum envelope is unable to withstand 1 atmosphere or greater external pressure without inclusion of the spacer walls. If the spacer walls are not included then the faceplate and backplate can collapse. In rectangular displays, having greater than approximately a 1 inch diagonal, the faceplate and backplate are particularly susceptible to this type of mechanical failure due to their high aspect ratio, which is defined as the larger dimension of the display divided by the thickness of the faceplate or backplate. The use of spacer walls in the interior of the field emission device substantially eliminates this mechanical failure.

The use of spacer walls has been reported in U.S. Pat. Nos. 4,900,981; 5,170,100; EPO 464 938 A1; EPO 436 997 A1; EPO 580 244 A1; and EPO 496 450 A1.

The faceplates and backplates for the desired flat, light portable display are typically about 1 mm thick. To avoid seeing the spacer walls at the exterior of the faceplate, the spacer walls should be hidden behind a suitable structure such as a black matrix.

Additionally, flat panel displays to date and standard CRT's have high-temperature assembly requirements, including but not limited to plasma addressed liquid crystal (PALC), and the like, where the alignment during assembly consists of external, mechanical alignment of the faceplate and the backplate so that the correspondence of the phosphor pixels and the associated cathode emitters are initially within tolerance. These external fixturing devices travel with the field emission display through the required high temperature bonding and sealing processes. External fixturing devices have difficulties in maintaining a high precision of alignment because of differences in the coefficient of thermal expansion between the field emission display and the fixturing. Resulting misalignment gives a loss of color purity and resolution in the field emission display. Another disadvantage of external tooling is the cost of individual fixture tooling for each field emission display during the sealing and thermal processing of the displays.

It would be desirable to provide a field emission display which does not use external fixturing devices in the high temperature bonding and sealing processes. There is a need for a field emission display that includes fiducials to optically align the faceplate and the backplate, and at least one internal structure that fixes and constrains the faceplate and the backplate in order to align a plurality of phosphor pixels with corresponding field emitters.

SUMMARY

Accordingly, it is an object of the invention to provide a field emission display device that does not use external fixturing devices during the high temperature bonding and sealing processes for aligning a plurality of phosphor pixels with corresponding field emitters.

Another object of the invention is to provide a field emission device which includes internal structures to fix and constrain the faceplate and backplate, and align the phosphor pixels with corresponding field emitters.

Yet another object of the invention is to provide a field emission display device with high resolution, contrast and good color purity.

Still a further object of the invention is to provide a field emission display device with high brightness at high voltage that uses a black matrix so that internal spacer walls are not viewed at the outside of the faceplate.

Another object of the invention is to provide fiducials on the faceplate and the backplate that provide optical alignment of one to the other, and a one-to-one correspondence between a field emitter and a phosphor pixel.

These and other objects are achieved in a field emission display device that includes a faceplate and a backplate. The faceplate has an interior side with an active region made of pluralities of phosphor pixel elements. The backplate has an interior side with pluralities of field emitters, each plurality of field emitters defining a sweet spot. Sidewalls are positioned between the faceplate and the backplate to form an enclosed sealed envelope between the sidewalls, backplate interior side and the faceplate interior side. At least one spacer wall is positioned in the envelope to support the backplate and the faceplate against forces acting in a direction toward the envelope. Further, at least one internal structure is included that fixes and constrains the faceplate and the backplate relative to each other, and aligns a phosphor pixels with corresponding field emitters.

The internal structure includes a spacer wall gripper with a receiving trench formed on the interior side of the faceplate, and a locator formed on the interior side of the backplate. The spacer wall is mounted in the receiving trench and is retained in the locator. The wall gripper has sufficient flexibility to receive the spacer wall in a substantially straightened geometry which is easily maintained throughout the sealing and thermal processing of the display. Each receiving trench has a trapezoid geometry which is very effective in gripping the spacer wall. The width of the receiving trench is the same width or smaller than a width of the spacer wall.

The faceplate and backplate can each include an alignment fiducial. A spacer wall is positioned in the wall gripper. The faceplate and backplate fiducials are then optically aligned, and brought together so that the spacer wall becomes positioned in the locator. This essentially eliminates the need for external fixturing devices during the bonding and sealing stages, and the phosphor pixels are aligned with the corresponding field emitters.

One end of the spacer wall is fixably mounted in the receiving trench by the use of, for example, a frit. The spacer wall can have a different coefficient of thermal expansion than the faceplate or the backplate. This results because the receiving trench is able to grip and position the spacer walls even though there is a difference in thermal expansion of the faceplate, backplate and spacer walls during thermal and sealing processing.

DESCRIPTION OF THE DRAWINGS

FIG. 4(*b*) is an exploded view of the field emission device with fiducials formed in the faceplate substrate and the focus grid.

FIG. 6(*b*) illustrates a perspective view, as in FIG. 6(*a*), with the spacer wall being introduced into the receiving trench.

FIG. 7(*b*) is a perspective view of the faceplate interior side with spacer walls positioned in receiving trenches formed in the black matrix.

DETAILED DESCRIPTION OF THE PREFERRED EMBODIMENTS

In the following description, embodiments of the invention are described with respect to a field emission device, more particularly, to a flat cathode ray tube display.

Herein, a flat panel display is a display in which a faceplate and backplate are substantially parallel, and the thickness of the display is small compared to the thickness of a conventional deflected-beam CRT display. The thickness of the display is measured in a direction substantially perpendicular to the faceplate and backplate. Often the thickness of a flat panel display is substantially less than about 2.0 inches, and in one embodiment it is about 4.5 to 7.0 mm.

Figure 1:
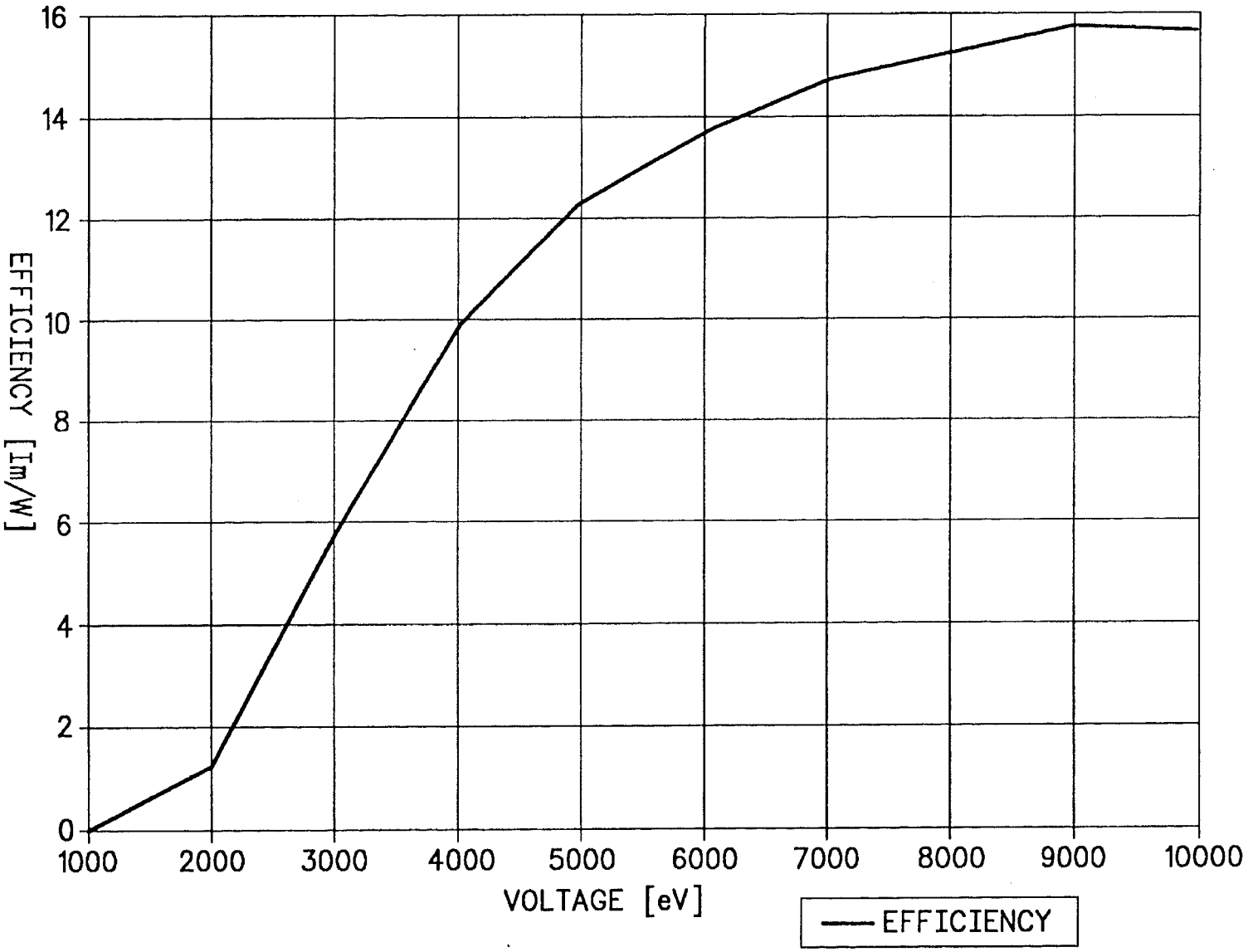
FIG. 1 is a graph of a curve of luminous efficiency verses voltage for a representative cathode luminescent phosphor.
Figure 2:
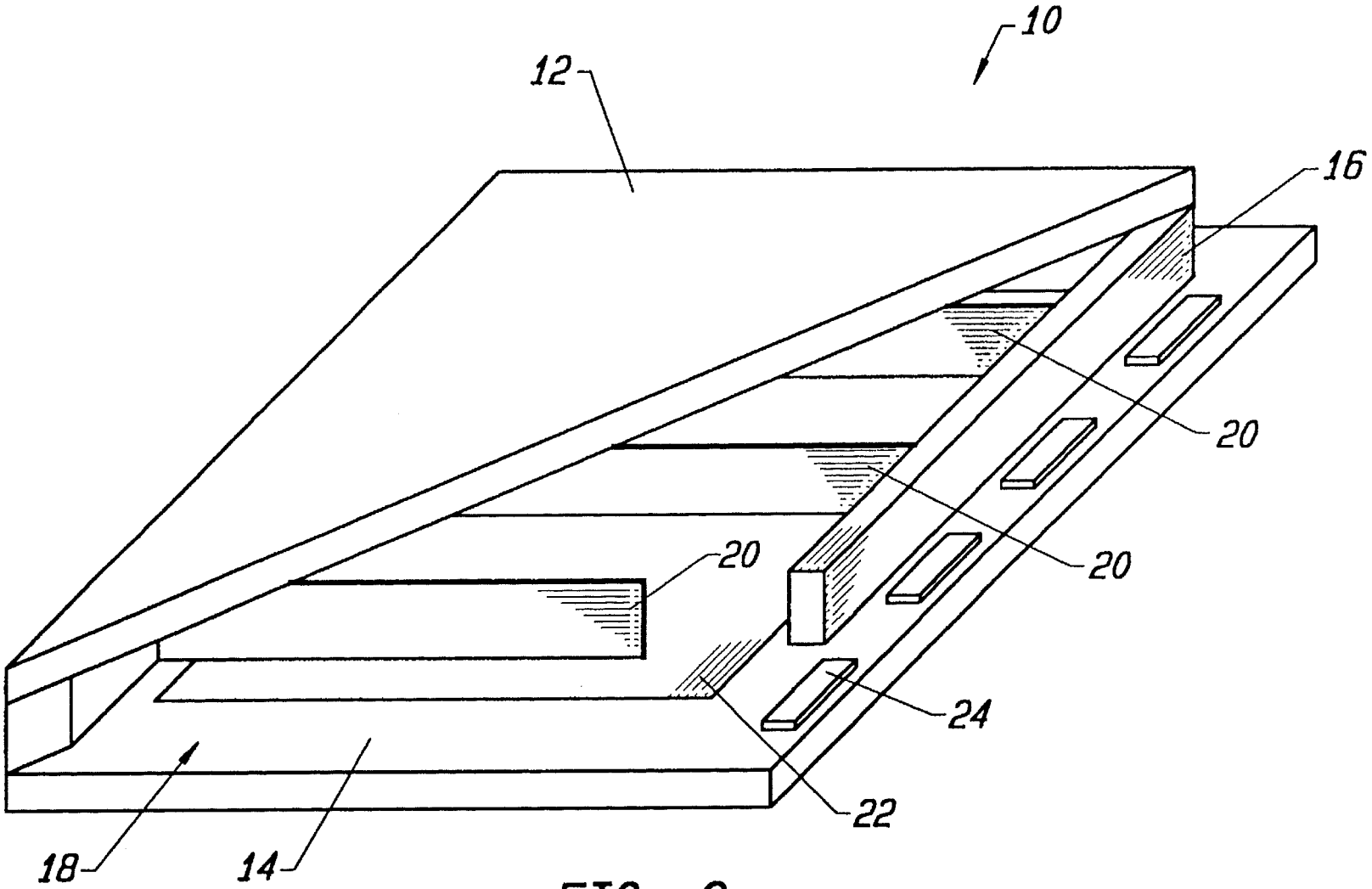
FIG. 2 is a perspective view of a field emission display device.

Referring now to FIG. 2, a flat panel display 10 includes a faceplate 12, backplate 14 and side walls 16, which together form a sealed envelope 18 that is held at vacuum pressure, e.g., approximately $1\times10^{-7}$ torr or less. One or more spacer walls 20 support faceplate 12 against backplate 14. Spacer walls 20 can include electrodes positioned along their longitudinal length. For purposes of this disclosure, spacer walls 20 include walls, posts and wall segments.

Further, spacer walls 20 have a sufficiently small thickness so that they provide minimal interference with the operation of flat panel display 10, particularly the cathodes (field emitters) and phosphors of the device. Spacer walls 20 are made of a ceramic, glass, glass-ceramic, ceramic tape, ceramic reinforced glass, devitrified glass, amorphous glass in a flexible matrix, metal with electrically insulating coating, bulk resistivity materials such as a titanium aluminum chromium oxide, high-temperature vacuum compatible polyimides or insulators such as silicon nitride. Spacer walls 20 have a thickness of about 20 to 60 μm, and a center-to-center spacing of about 8 to 10 mm. Spacer walls 20 provide internal supports for maintaining spacing between faceplate 12 and backplate 14 at a substantially uniform value across the entire active area of the display at an interior surface of faceplate 12.

A plurality of field emitters 22 are formed on a surface of backplate 14 within envelope 18. For purposes of this disclosure, field emitters 22 can include a plurality of field emitters or a single field emitter. Row and column electrodes control the emission of electrons from field emitters 22. The electrons are accelerated toward a phosphor coated interior surface of faceplate 12. Integrated circuit chips 24 include driving circuitry for controlling the voltage of the row and column electrodes so that the flow of electrons to faceplate 12 is regulated. Electrically conductive traces are used to electrically connect circuitry on chips 24 to the row and column electrodes.

Figure 3:
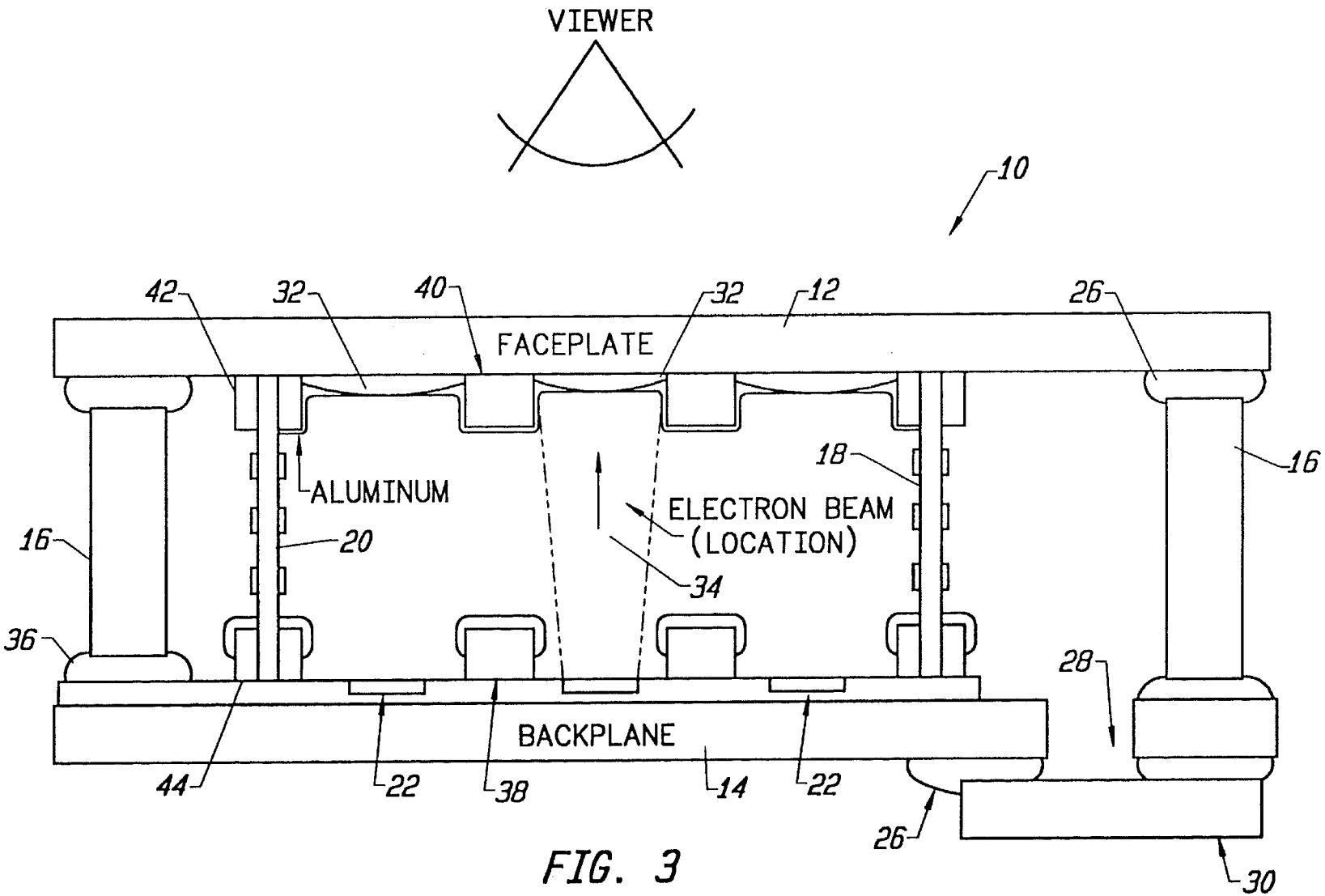
FIG. 3 is a cross-sectional view of the field emission display device of FIG. 2.

Referring now to FIG. 3, faceplate 12 and backplate 14 consist of glass that is about 1.1 mm thick. A hermetic seal 26 of solder glass, including but not limited to Owens-Illinois CV 120, attaches side walls 16 to faceplate 12 and backplate 14 to create sealed envelope 18. The solder glass must withstand a 450 degree C. sealing temperature. Within envelope 18 the pressure is typically $10^{-8}$ torr or less. This high level of vacuum is achieved by evacuating envelope 18 through pump port 28 by high temperature to cause absorbed gasses to be removed from all internal surfaces. Envelope 18 is then hermetically sealed at a pump port patch 30.

Faceplate 12 includes pluralities of pixels. In order to provide good purity of color and high resolution, electrons emitted by field emitters 22 are directed to, and fall only on a corresponding plurality of pixels. An electron beam 34 from field emitters 22 is focussed and directed by a focus grid 38 to a color picture element comprised of a plurality of phosphors 32, and a black matrix 40 formed on an interior side of faceplate 12.

Various parameters are associated with the direction of electrons from field emitters 22 relative to the proper associated plurality of phosphor pixels 32. These include, but are not limited to, (i) the precision of location of the field emitter 22 to focus grid 38, (ii) the precision of location of the plurality of phosphor pixels 32 relative to black matrix 40, and (iii) the alignment of focus grid 38 to black matrix 40. A light reflective layer, including but not limited to aluminum, is deposited on black matrix 40 and phosphor pixels 32 with a thickness of about 200 to 600 Å.

The ratio of area of the plurality of phosphor pixels 32 to black matrix 40 for a 10 inch diameter screen with color resolution of 640(×3)×480 picture elements is about 50%. The minimum width of black matrix 40 is therefore about 0.001 inches. This implies a maximum misalignment of electron beam 34 to the corresponding phosphor pixels 32 (from all contributors) to be less than half the maximum black matrix width (0.0005 inches) at any location of field emission device 10.

Field emission display 10 includes at least one internal structure in envelope 18 that fixes and constrains faceplate 12 to backplate 14, and thus aligns a plurality of phosphor pixels 32 with a corresponding sweet spot associated with the field emitters 22 to within a predetermined tolerance of 0.0005 inches or less. This internal structure is a wall gripper 42 formed on an internal side of faceplate 12, and a locator 44 formed on an interior side of backplate 14. It will be appreciated that wall gripper 42 can be formed on back plate 14, and locator 44 can be formed on faceplate 12. A spacer wall 20 is mounted in wall gripper 42, and retained in locator 44. The most significant parameter of the alignment issue is the precision to which faceplate 12, e.g., black matrix 40 and phosphor pixels 32, is aligned to backplate 14, e.g., focus grid 38 and field emitters 22, and thereafter held in place without movement during the thermal assembly process. This is achieved with the internal structure in envelope 18 without the use of external fixturing devices.

Black matrix 40 is made of a photo-patternable material including but not limited to black chromium, polyimide, black frit, and the like. Both black matrix 40 and focus grid 38 are configured by photolithography. The phototooling to create black matrix 40 is substantially the same as the phototooling used to create focus grid 38, wall gripper 42 and locator 44.

Spacer walls 20 are first mounted in wall gripper 42. Thereafter, faceplate 12 and backplate 14 are locked together, to within the allowed tolerances, by positioning spacer walls 20 in corresponding locators 44.

Figure 4A:
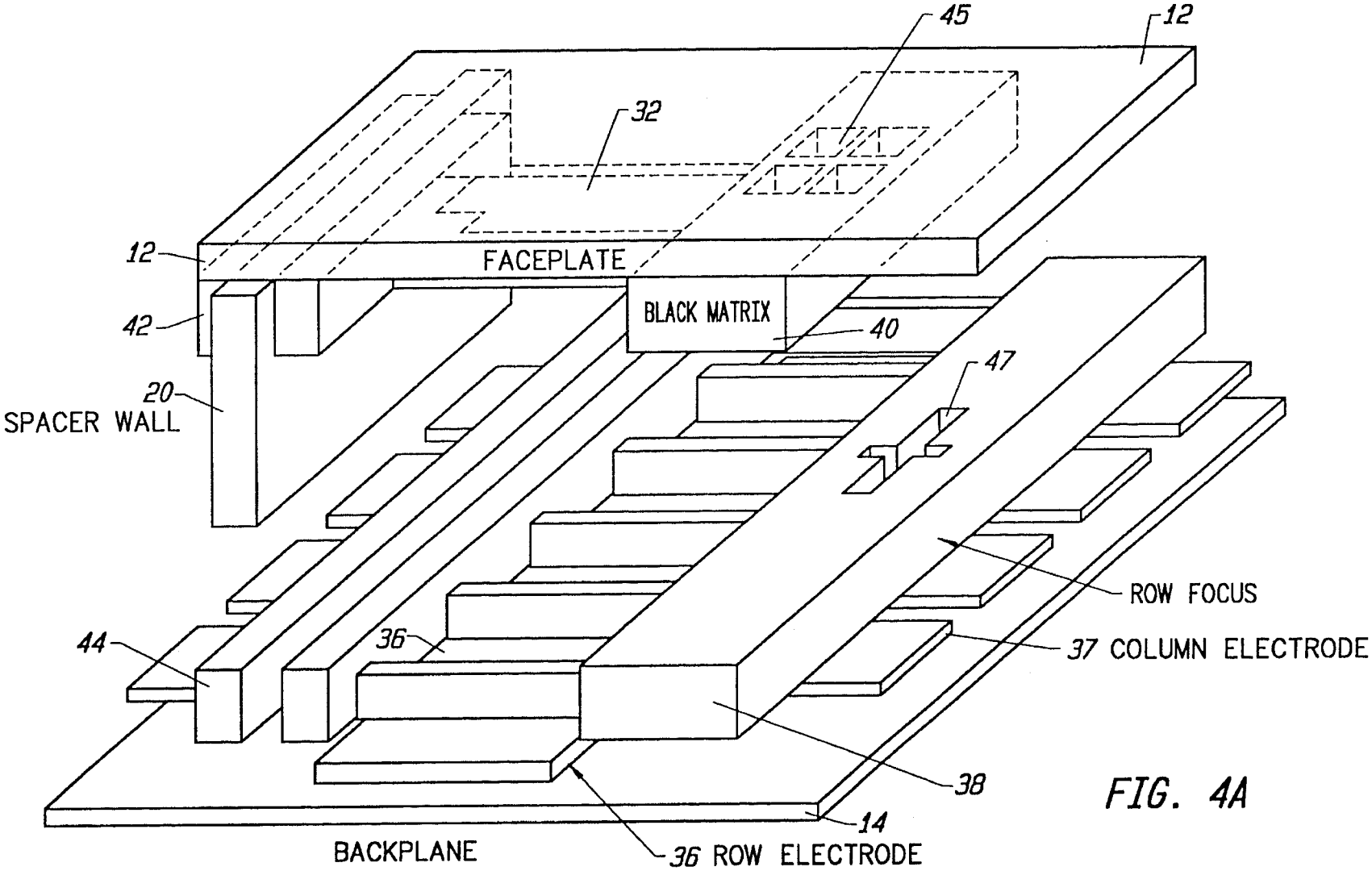
FIG. 4(*a*) is an exploded view of the field emission device with fiducials formed in the black matrix and the focus grid.
Figure 4B:
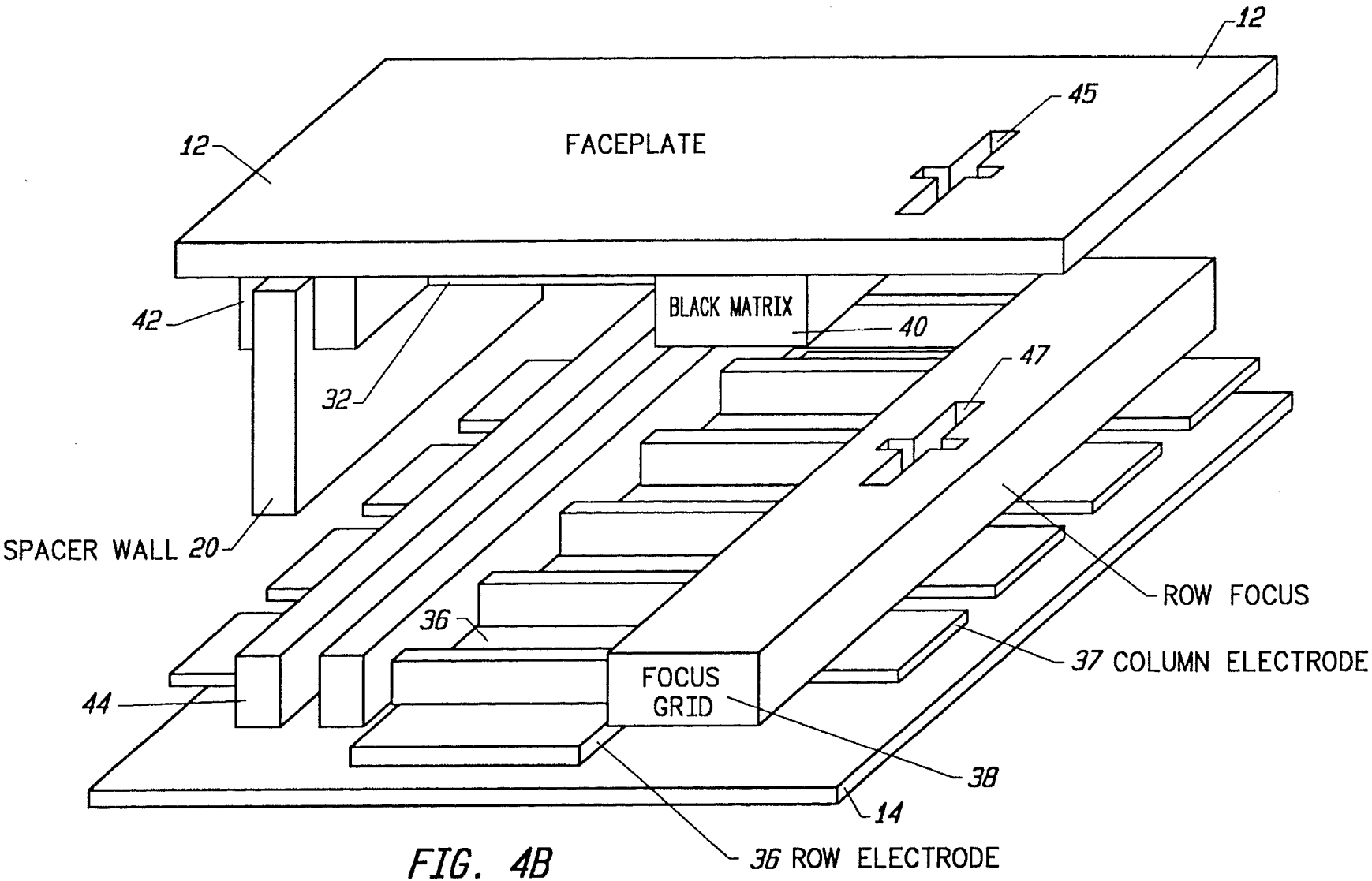

Referring now to FIGS. 4(*a*) and 4(*b*), alignment of faceplate 12 and backplate 14 is achieved with optical alignment fiducials 45 and 47, which can be integral to the structure of black matrix 40 and focus grid 38 respectively. Additionally, masks for fiducials 45 and 47 are integral to the phototooling, creating a geometric relationship between fiducial 47 and black matrix 40, and fiducial 45 to focus grid 38. Optionally, fiducials 45 and 47 can be on each of the substrates of faceplate 12 and backplate 14 respectively and not part of black matrix 40. In any event, fiducials 45 and 47 provide optical alignment of faceplate 12 to backplate 14, and of field emitters 22 to corresponding phosphor pixels 32. When fiducials 45 and 47 are in optical alignment, e.g., when collimated light falls on faceplate 12 which is transparent to the light, the image of faceplate alignment fiducial 45 is projected onto and maps to backplate fiducial 47. A shadow mask is provided to permit the passage of optical light through fiducials 45 and 47.

The mounted spacer walls 20 are physically strong and rigid enough to withstand atmospheric pressure, and maintain alignment of faceplate 12 and backplate 14 through the sealing and thermal processing of the display. The shape of wall gripper 42, as more fully described hereafter, is designed to grip spacer wall 20 tightly and retard its movement.

Figure 5:
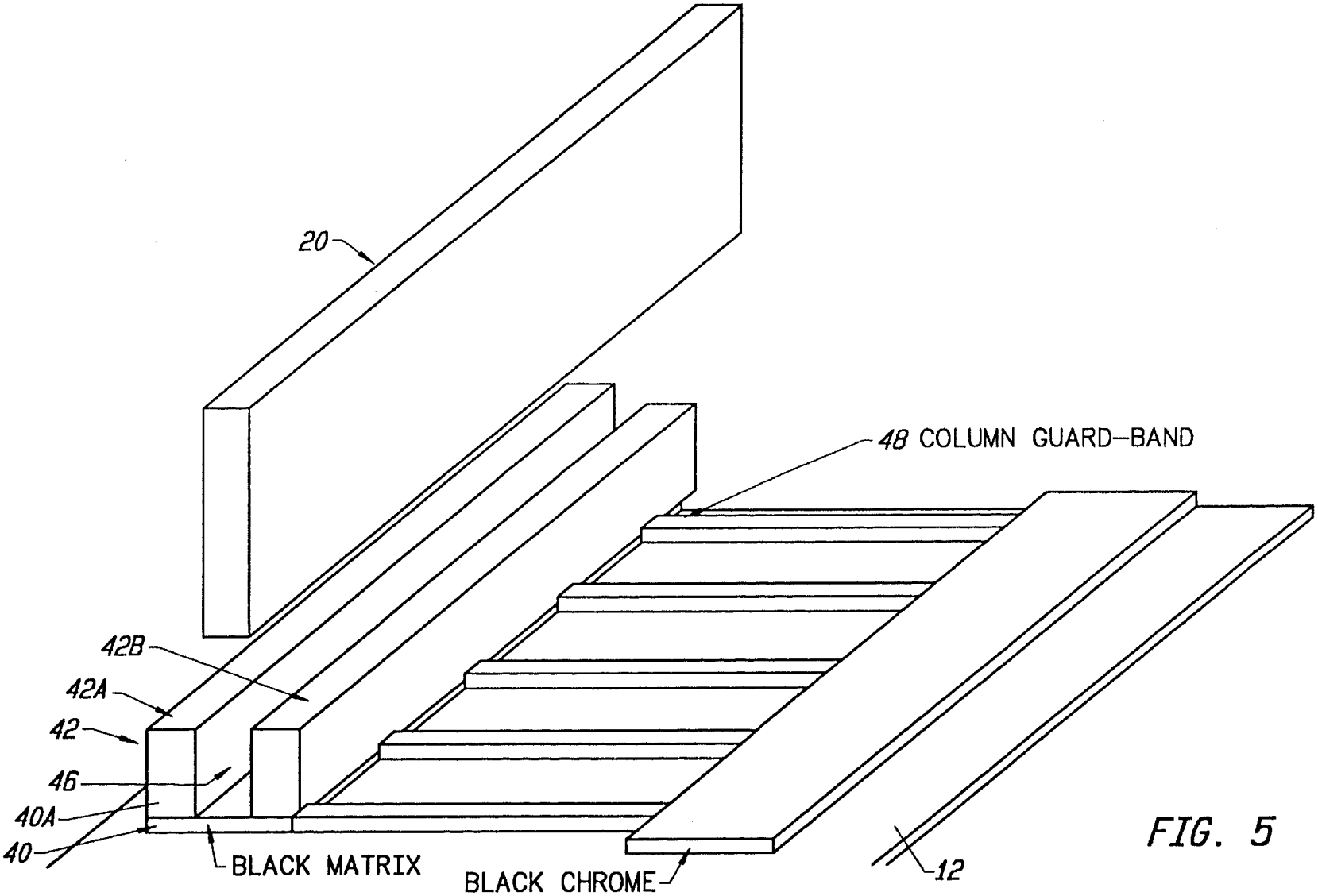
FIG. 5 is an enlarged perspective view of a spacer wall gripper formed at the interior side of the faceplate.

As shown in FIG. 5, black matrix 40 comprises column and row guard bands. Wall gripper 42 is formed on black matrix 40. Preferably, wall gripper 42 is formed in a column or row guard back. Wall gripper 42 has a height of about 0.001 inches or greater. A second layer of black matrix 40(*a*) is formed to create wall gripper 42, which is essentially a pair of raised structures 42(*a*) and 42(*b*), creating a receiving trench 46 for spacer wall 20. Wall gripper 42 is formed in a generally perpendicular direction in relation to a series of column guard bands 48. Wall gripper 42 is not visible or distinguishable from a row guard band 50 not containing a wall gripper. When viewed at the exterior of faceplate 12, wall gripper 42 is not visible or distinguishable from row guard band 50, and thus has optical integrity. That is, the viewed footprint is the same for a row guard band 50 with a wall gripper 42 as that of a row guard band 50 without a wall gripper 42.

Figure 6B:
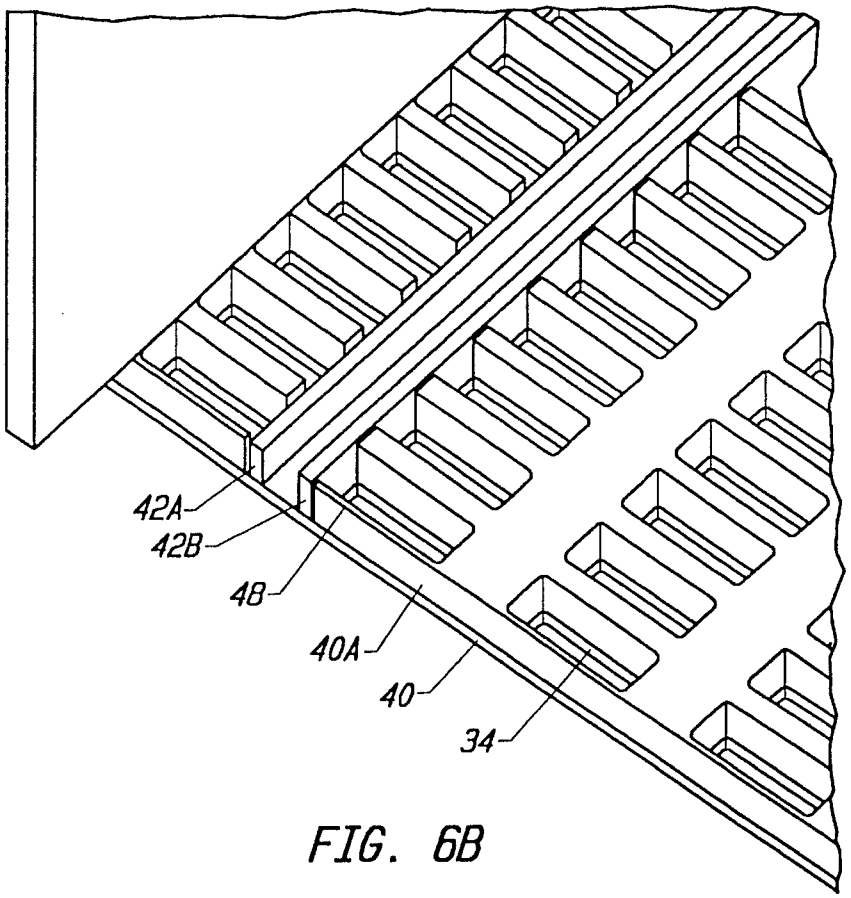
FIG. 6(*a*) is a perspective view of the spacer wall gripper and the pluralities of phosphor pixels.
Figure 6A:
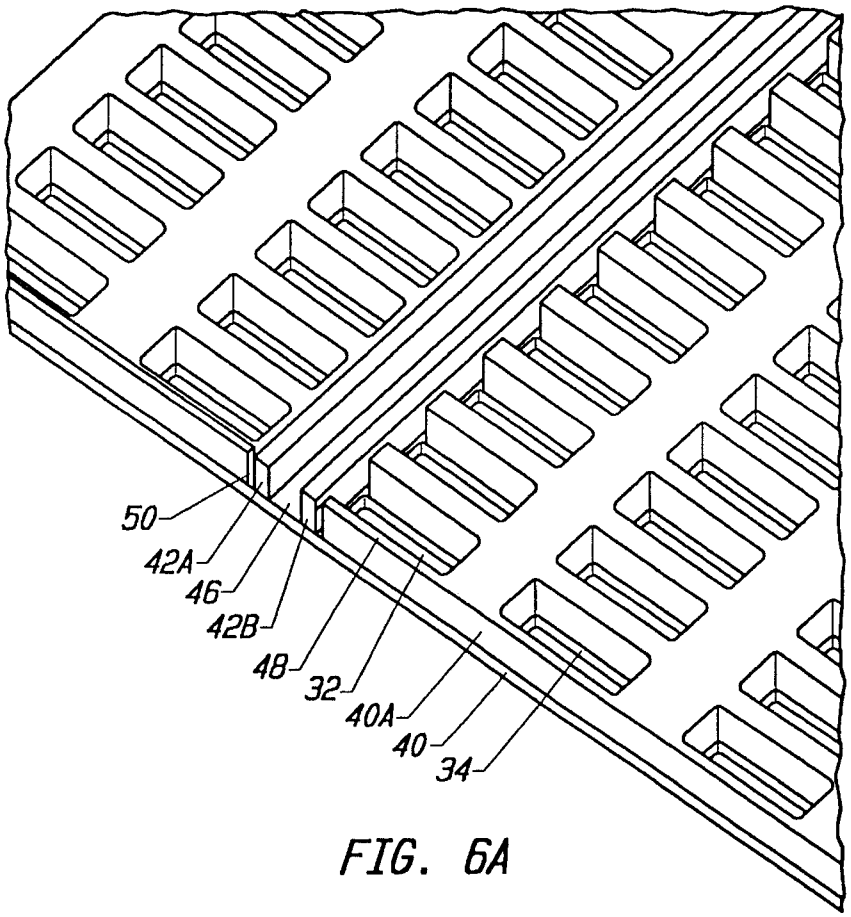

In FIG. 6(*a*), a first layer of black matrix 40 is formed, and then a second layer of black matrix 40(*a*) is created. Second layer 40(*a*) creates wall gripper 42, with the corresponding raised structures 42(*a*) and 42(*b*) defining a receiving trench 46. As illustrated, pluralities of phosphor pixels 32 are defined by black matrix 40 and second layer of black matrix 40(*a*). FIG. 6(*b*) illustrates the introduction of a spacer wall 20 into receiving trench 46.

Figure 7B:
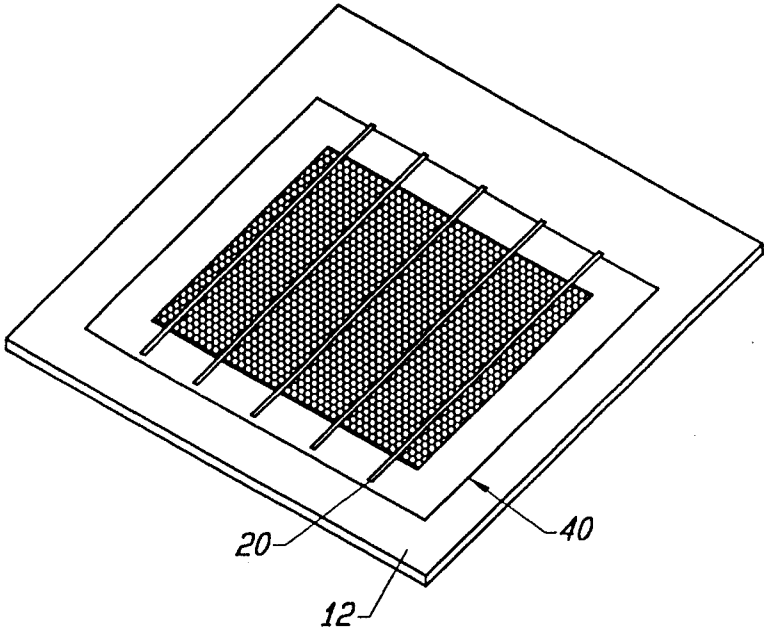
FIG. 7(*a*) is a perspective view of the spacer wall positioned in the receiving trench formed in the black matrix.
Figure 7A:
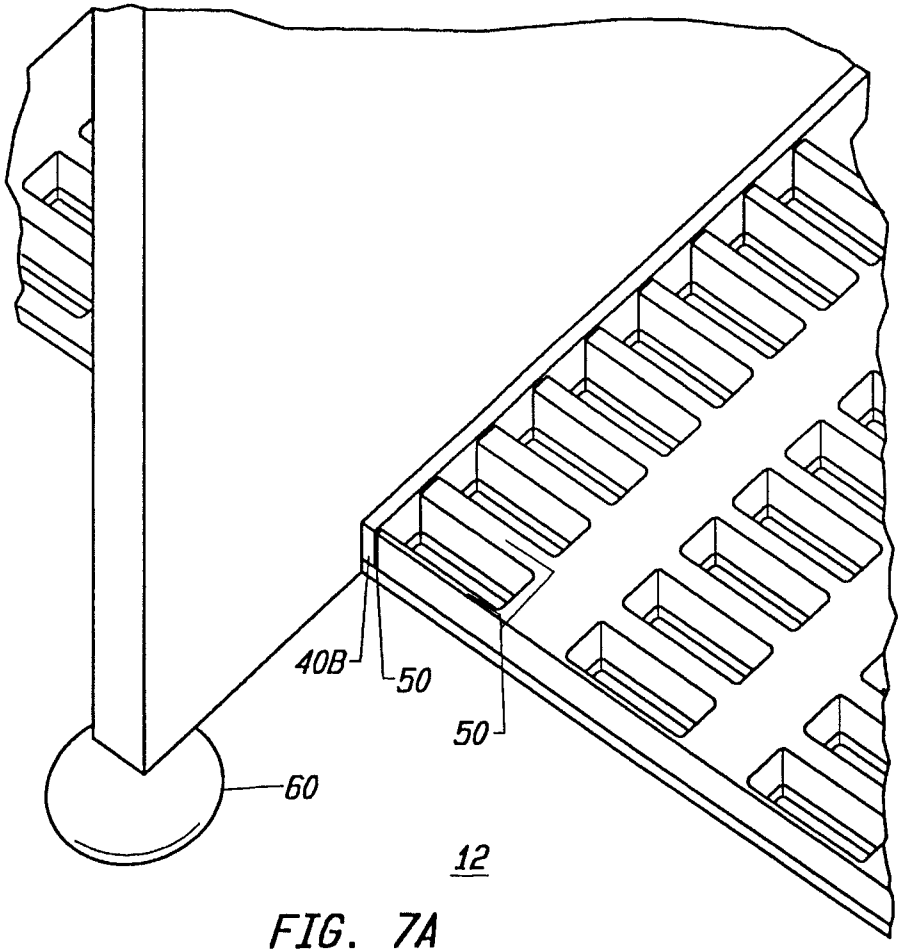

FIG. 7(*a*) illustrates spacer wall 20 positioned in receiving trench 46. In FIG. 7(*b*) a perspective view of an interior side of faceplate 12 shows black matrix 40 and five spacer walls 20 positioned in wall grippers 42.

The material forming wall gripper 42 is vacuum-compatible at processing temperatures in that it does not decompose or create gas contaminants. Processing temperatures are in the range of about 300 to 450 degrees C. Wall gripper 42 is sufficiently flexible (capable of local deformation) to permit spacer walls 20 to have greater thicknesses than receiving trench 46, and still be capable of insertion into receiving trench 46. Wall gripper 42 also provides a straightening effect on spacer walls 20. Wall gripper 42 is capable of sufficient local deformation to straighten spacer walls 20.

Figure 8:
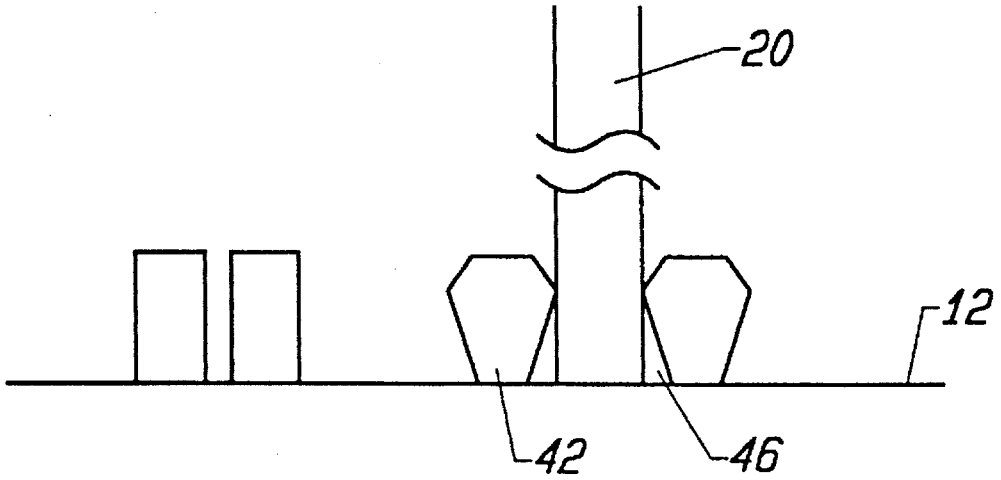
FIG. 8 is a cross-sectional view of a wall spacer in a receiving trench, and illustrates that the receiving trench is flared with a trapezoid geometry.
Figure 9A:
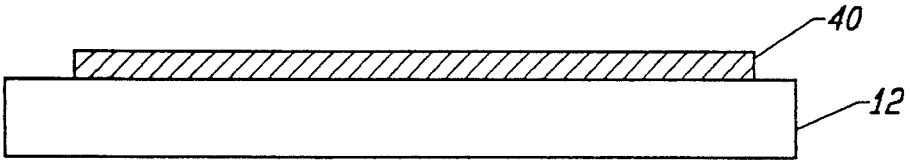
FIGS. 9*a*–9*e* illustrate a process for creating the wall gripper structure.
Figure 9B:
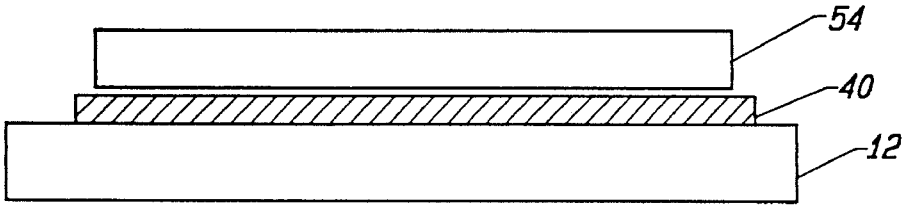
Figure 9C:
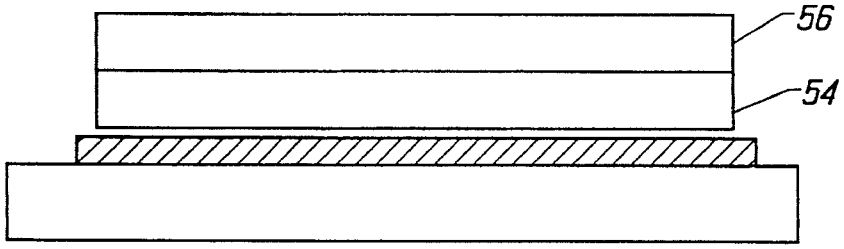
Figure 9D:
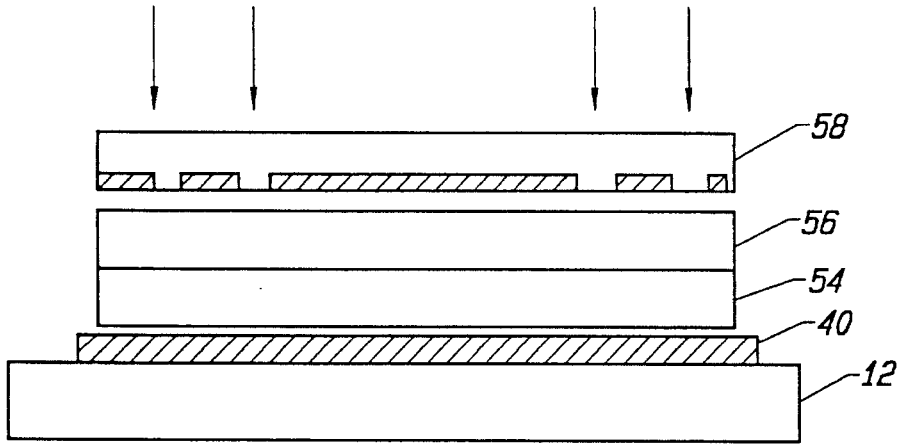
Figure 9E:
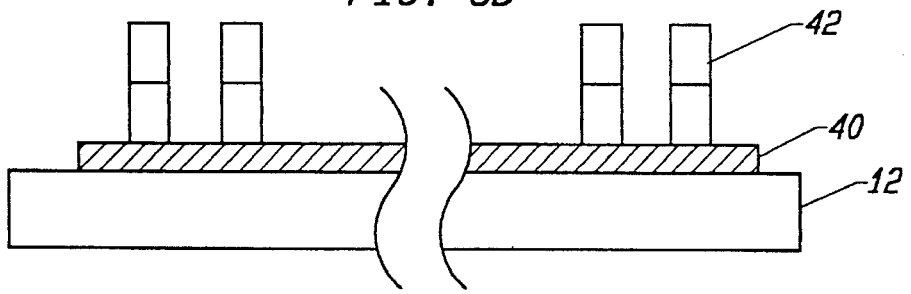
Figure 10A:
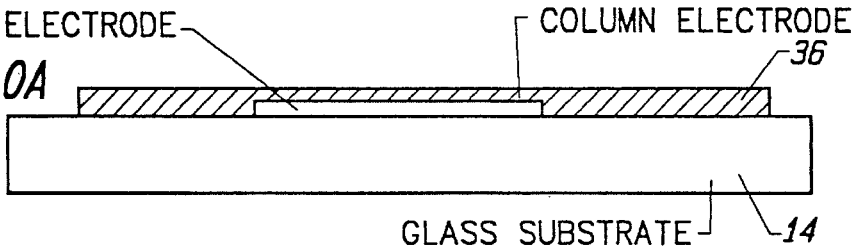
FIGS. 10*a*–10*e* illustrate a process for creating a locator formed on the interior side of the backplate.
Figure 10B:
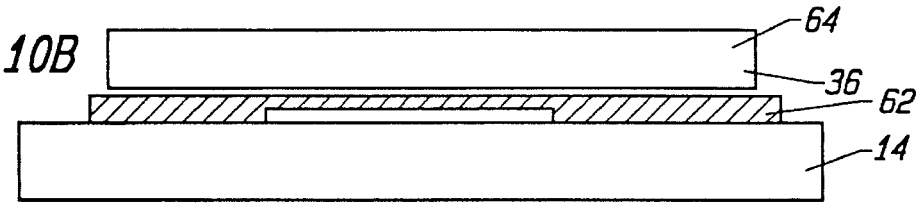
Figure 10C:
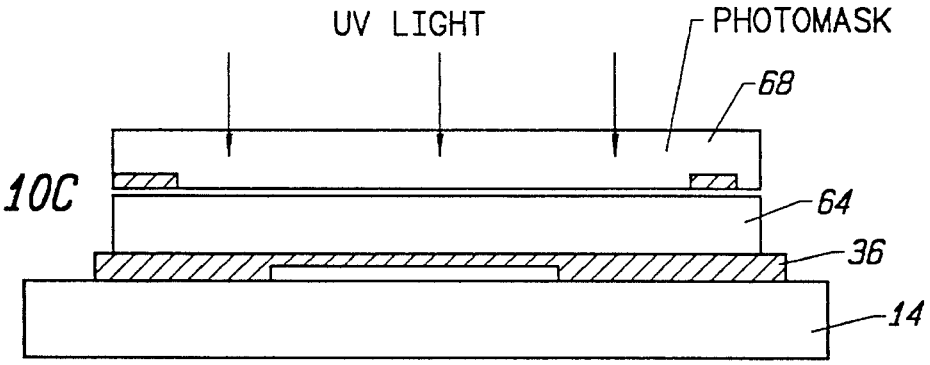
Figure 10D:
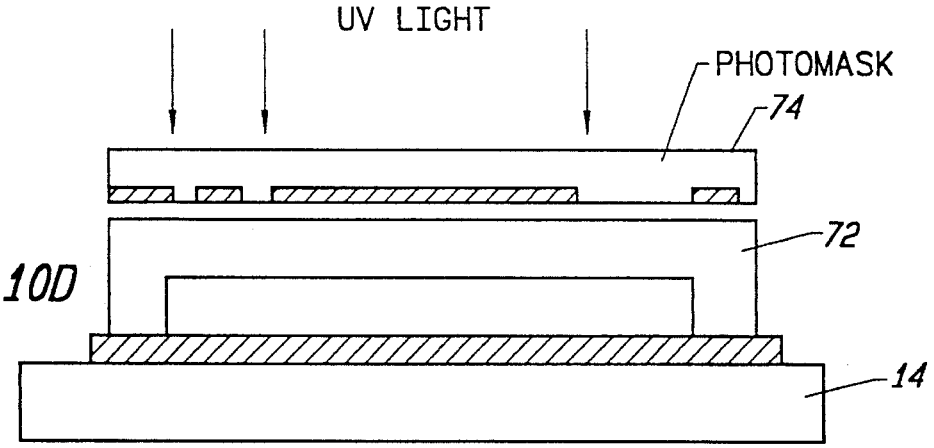
Figure 10E:
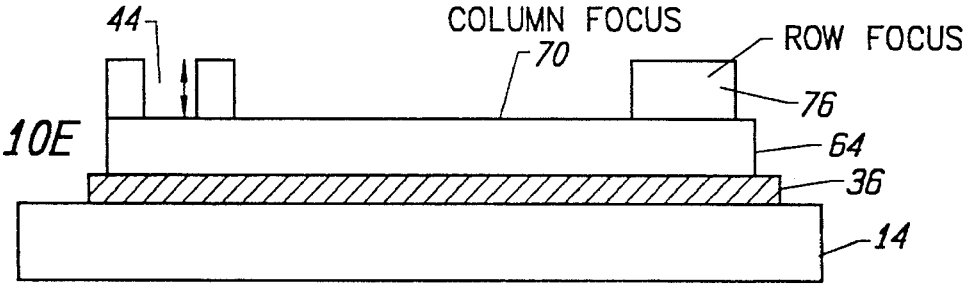

As shown in FIG. 8, wall gripper 42 has a receiving trench 46 geometry with a narrower aperture at the point of receiving a spacer wall 20, than the bottom of receiving trench 46. In one embodiment, the depth of receiving trench 46 can be about 0.002 inches.

One embodiment of the process for forming wall gripper 42 is now described, with reference to FIG. 9.

A preferred material for wall gripper 42 is a photodefinable polyimide, such as OCG Probimide 7020, or other similar polymers from DuPont, Hitachi and the like.

Black matrix 40 is created from black chromium and photopatterned by conventional lithography on faceplate 12. A first layer of Probimide 7020, polyimide denoted as 54, is deposited on black matrix 40 by conventional spin deposition at 750 RPM for 30 seconds. Faceplate 12 is then baked on a hot plate at 70 degrees C. for 6 minutes, followed by 100 degrees C. for twenty minutes, to drive off solvents.

A second layer of Probimide 7020, polyimide denoted as 56, is deposited and baked under the same conditions as layer 54. The soft baked Probimide 7020 polyimide 56 is then photoexposed with an exposure dose of 250 mJ/sq cm at 405 nm through a mask 58 in proximity to Probimide 7020 polyimide 56. Exposed Probimide 7020 polyimide layer 56 is then baked for 3 minutes at 100 degrees C., followed by a room temperature stabilization of 15 minutes. Probimide 7020 polyimide layer 56 at this time has an exposure energy profile that creates the trapezoid shape, illustrated in FIG. 8, that imparts the gripping function of wall gripper 42.

The Probimide 7020 polyimide is then developed in OCG QZ3501 by a puddle/spray cycle: [3 minutes puddle/1 minute, spray-repeat 1X] followed by a solvent rinse (OCG QZ 3512) for 1 minute. The developed wall gripper 42 is then hard baked for 1 hour at 450 degrees C. in a nitrogen atmosphere with a thermal ramp of 3 degrees C. per minute.

Spacer walls 20 are then inserted into wall gripper 42, as shown in FIG. 7(*a*). As illustrated, the insertion axis is perpendicular to the plane of faceplate 12. Insertion can also be accomplished parallel to the plane of faceplate 12 ( i.e. slide spacer wall 20 into receiving trench 46 from one end). Spacer wall 20 extends beyond black matrix 40 in an amount sufficient to secure one of its ends with solder glass 60 to substrate 12. Receiving trench 46 has one ore more flared ends to facilitate spacer wall 20 insertion.

FIG. 7(*a*) shows spacer wall 20 in place with only one end secured by solder glass 60, or other high temperature adhesives. Other suitable adhesives include but are not limited to polyimide, and the like. Solder glass 60 can be, but is not limited to, OI CV 120. The assembly shown in FIG. 7(*a*) is then baked for one hour at 450 degrees C. to devitrify solder glass 60. A suitable oven ramp is 3 degrees C./minute. Securing one end of spacer wall 20 provides mechanical stability of spacer wall 20 for subsequent processing. Additionally, since there is differential expansion and contraction during thermal processing, when spacer walls 20 are secured or pinned at both ends buckling of spacer wall 20 results. Securing spacer wall 20 at only one end enables the use of materials with substantially different coefficients of thermal expansion for spacer walls 20, faceplate 12 and backplate 14, because all differential movement of spacer wall 20 is along the axis of receiving trench 46.

It will be appreciated that the present invention is not limited to the preceding example of a process cycle. The present invention can be created with various modifications of this process cycle.

As shown in FIG. 3, spacer wall 20 is fixed and constrained by wall gripper 42 and locator 44, and then once faceplate 12 and backplate 14 are optically aligned, spacer wall 20 is fixed and constrained in locator 44. Backplate 14 of display 10 is constructed to provide correspondence of features with faceplate 12 so that field emitters 22 communicate with the corresponding plurality of phosphor pixels 32, and wall gripper 42 is in optical alignment with locator 44. Wall locator 44 is formed by phototooling compatible with the tooling set used to create wall gripper 42, black matrix 40 and focus grid 38. Focus grid 38 is self aligned to field emitters 22.

Consequently, faceplate 12 with spacer walls 20 attached, may be brought into proximity to backplate 14, and be manipulated in the (x,y,0) axes so as to bring spacer wall 20 into alignment with wall locator 44, and a respective plurality of phosphor pixels 32 into alignment with its corresponding sweet spot 36. Faceplate 12 may then be translated in the z axis to cause spacer wall 20 to insert into wall locator 44. This assembly provides precision of alignment in the (x,y,0) axis and is held and maintained in position by the mechanically rigid structure formed by spacer walls 20, wall gripper 42 and locator 44. This structure may then be transported through a standard cycle of high temperature sealing and evacuation. Solder-glass may be used in the sealing process. This is done by baking at 450 degrees C. for one hour and using a 3 degree C./minute thermal ramp. The only fixturing required is to provide sufficient force to hold faceplate 12 and backplate 14 together to maintain contact. No external locating and aligning fixturing is required during thermal processing.

Figure 11:
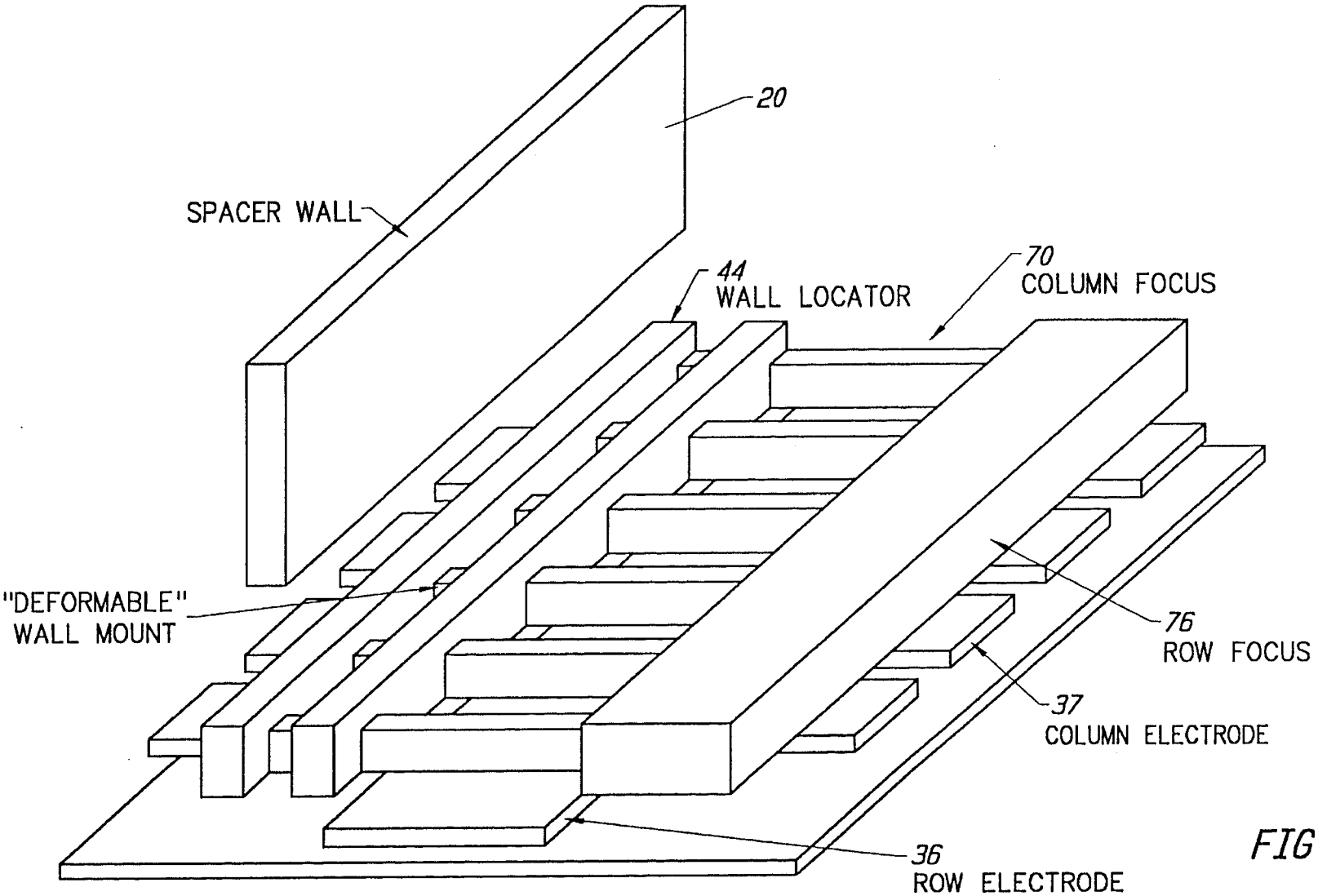
FIG. 11 is a perspective view of the backplate.

With reference now to FIGS. 10 and 11, a process for forming locator 44 on backplate 14 is illustrated beginning with backplate 14, row electrodes 86 and column electrode 37. Row and column metallization, together with gate oxide, electron emitter, gate metal (not shown), are formed on the interior surface of backplate 14.

A first layer 64 of OCG Probimide 7020 polyimide is deposited on backplate 14 to a dry thickness of 45 microns by conventional spinning means for 10 seconds at a spin speed of 750 rpm.

First layer 64 is soft baked in a two-step process for 6 minutes at a temperature of 79 degrees C. followed by 10 minutes at 100 degrees C. It is then exposed through a photomask 68 to define a column focus electrode 70. The exposure parameters are: UV light at wavelength from 350 to 450 nm for an exposure dose of 250 mJ/sq cm. The exposed pattern is then developed in OCG QZ 3501 developer for 3 minutes to form column focus 70 electrode 70.

A second layer 72 of Probimide 7020 polyimide is deposited to a dry thickness of 20 microns and exposed through a second photomask 74 using the same exposure and development parameters as first layer 64, to form row focus electrode 76 and locator 44. Locator 44 has a depth of about 10 μm.

The Probimide 7020 polyimide is imidized by baking at a temperature of 460 degrees C. in a nitrogen atmosphere for 1 hour.

Backplate structure includes electrically insulating backplate, a base electrode, an electrically insulating layer, metallic gate electrodes, field emitters positioned in gate electrodes, and focusing ridges positioned adjacent to gate electrodes.

The gate electrode lies on the insulating layer. The gate electrode is in the shape of a strip running perpendicular to the base electrode.

Field emitters contact the base electrode and extend through apertures in the insulating layer. The tips, or upper ends, of field emitters are exposed through corresponding openings in the gate electrode. Field emitters can have various shapes, including but not limited to cones, filament structures, and the like. Focusing ridges generally extend to a considerably greater height above the insulating layer than the a gate electrode. Preferably, the average height of focusing ridges is at least ten times the average height of a gate electrode. Typically, the height of focussing ridges is about 20 to 50 μm.

Field emitters emit electrons at off-normal emission angles when a gate electrode is provided with a suitably positive voltage relative to the field emitter voltage. Emitted electrons move towards phosphor pixels. When struck by these electrons, phosphor pixels emit light.

Focusing ridges influence trajectories in such a way that the one-to-one correspondence of phosphor pixels to field emitters is maintained. The phosphors are struck by substantially all of the emitted electrons.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

What is claimed is:

1. A field emission display device, comprising:

a faceplate including a faceplate interior side with an active region made of a plurality of phosphor pixels;

a backplate including a backplate interior side with a plurality of field emitters;

sidewalls positioned between the faceplate and the backplate to form an enclosed sealed envelope between the sidewalls, backplate interior side and the faceplate interior side;

at least one spacer wall in the envelope supporting the backplate and the faceplate against forces acting in a direction toward the envelope; and at least one internal structure that fixes and constrains the faceplate and the backplate, and aligns the plurality of phosphor pixels with corresponding field emitters, the internal structure including a spacer wall receiver formed on the interior side of the faceplate.

2. The field emission display device of claim 1 wherein the spacer wall receiver includes a receiving trench formed on the interior side of the faceplate.

3. The field emission display device 2, wherein the internal structure includes, a locator formed on the interior side of the backplate.

4. The field emission display of claim 3, wherein the spacer wall is mounted at the interior side of the faceplate in the receiving trench, and retained in the locator at the interior side of the backplate.

5. The field emission device of claim 2, wherein the receiving trench straightens the spacer wall.

6. The field emission device of claim 2, wherein the receiving trench has a first end that is closer to the faceplate interior side than a second end, and the second end is flared inward relative to the first end.

7. The field emission device of claim 6, wherein the receiving trench has a width that is the same or smaller than a width of the spacer wall.

8. The field emission display of claim 1, including a black matrix grid positioned adjacent to the faceplate interior side, the black matrix grid including the wall receiver and a receiving trench that receives the spacer wall and mounts it relative to the plurality of phosphor pixels.

9. The field emission device of claim 8, wherein the black matrix is made of a photo patternable material.

10. The field emission device of claim 9, wherein the photo patternable material is polyimide.

11. The field emission device of claim 8, wherein the spacer wall is substantially optically invisible to a viewer when viewed at an exterior surface of the faceplate.

12. The field emission device of claim 1, wherein one end of the spacer wall is fixably mounted to the faceplate.

13. The field emission display device of claim 1, wherein the spacer wall has a different coefficient of thermal expansion than a coefficient of thermal expansion of the faceplate.

14. The filed emission display device of claim 1, wherein the internal structure includes a spacer wall receiver formed on the interior side of the backplate and a locator at the interior side of the faceplate.

15. A field emission display device, comprising:

a faceplate including a faceplate interior side with an active region made of a plurality of phosphor pixels, and at least one faceplate fiducial;

a backplate including a backplate interior side with a plurality of field emitters and at least one backplate fiducial;

sidewalls positioned between the faceplate and the backplate to form an enclosed sealed envelope between the sidewalls, backplate interior side and the faceplate interior side; and at least one spacer wall in the envelope supporting the backplate and the faceplate against forces acting in a direction toward the envelope, wherein the faceplate fiducial is optically aligned with the backplate fiducial, and the phosphor pixels with the corresponding field emitters.

16. The field emission display of claim 15, further comprising:

at least one internal structure that fixes and constrains the faceplate and the backplate, and aligns the plurality of phosphor pixels with corresponding field emitters.

17. The field emission display of claim 15, including a black matrix grid positioned adjacent to the faceplate interior side, the black matrix grid including a wall receiver and a receiving trench that receives the spacer wall and mounts it relative to the plurality of phosphor pixels.

18. The field emission display of claim 15, wherein the black matrix is made of polyimide.

19. The field emission device of claim 17, wherein the faceplate fiducial is formed on the black matrix.

20. The field emission device of claim 15, wherein the backplate fiducial is formed on a focusing structure.

21. The field emission display device of claim 16, wherein the internal structure includes, a spacer wall receiver formed on the interior side of the faceplate.

22. The field emission display device of claim 21, wherein the spacer wall receiver includes a receiving trench formed on the interior side of the faceplate.

23. The field emission display device of claim 22, wherein the internal structure includes, a locator formed on the interior side of the backplate.

24. The field emission display of claim 23, wherein the spacer wall is mounted at the interior side of the faceplate in the receiving trench, and retained in the locator at the interior side of the backplate.

25. The field emission device of claim 22, wherein one end of the spacer wall is fixably mounted to the faceplate.

26. The field emission device of claim 22, wherein the receiving trench straightens the spacer wall.

27. The field emission device of claim 16, wherein the spacer wall has a different coefficient of thermal expansion than a coefficient of thermal expansion of the faceplate.

28. The field emission device of claim 22, wherein the receiving trench has a width that is the same or smaller than a width of the spacer wall.

* * * * *